US006735547B1

(12) United States Patent
Yfantis

(10) Patent No.: US 6,735,547 B1
(45) Date of Patent: May 11, 2004

(54) METHOD AND APPARATUS FOR DETERMINING THE SIZE AND SHAPE OF A FOOT

(76) Inventor: Evangelos A. Yfantis, 1707 Crest Ave., Las Vegas, NV (US) 89119

( * ) Notice: Subject to any disclaimer, the term of this patent is extended or adjusted under 35 U.S.C. 154(b) by 43 days.

(21) Appl. No.: 09/684,150

(22) Filed: Oct. 6, 2000

(51) Int. Cl.[7] ..... G01D 7/00
(52) U.S. Cl. ..... 702/155
(58) Field of Search ..... 702/155; 382/2, 382/115; 369/561; 358/500; 348/252; 701/34

(56) References Cited

U.S. PATENT DOCUMENTS 5,025,476 A * 6/1991 Gould et al. ..... 382/2
5,483,601 A * 1/1996 Faulkner ..... 382/115
5,502,657 A * 3/1996 Endoh ..... 369/561
5,786,906 A * 7/1998 Shishizuka ..... 358/500
6,040,860 A * 3/2000 Tamura et al. ..... 348/252
6,301,532 B1 * 10/2001 Kull et al. ..... 701/34
6,374,681 B1 * 4/2002 Vanuytven ..... 73/862.046

* cited by examiner

*Primary Examiner*—John Barlow
*Assistant Examiner*—Tung S Lau
(74) *Attorney, Agent, or Firm*—Weide & Miller, Ltd.

(57) ABSTRACT

A method and apparatus for determining the shape and dimension of a human foot is disclosed. One embodiment of a method comprises the steps of obtaining an imprint of the foot, scanning the imprint of the foot to obtain pixel image data regarding the foot imprint at one or more points, determining at said one or more points the depth of the imprint from the pixel image data, and determining a size of said foot from the pixel image data. In one embodiment, an imprint is created by a person stepping onto a foam member. In one embodiment, the scanning step generates RGB pixel data and this data is converted to YIQ data. The depth of the imprint is generated using the Y or luminance value information for a point. In one embodiment, foot size information is determined from the scanned foot imprint. The foot size and shape data may be used to create an orthotic, shoe, sandal or the like.

14 Claims, 10 Drawing Sheets

METHOD AND APPARATUS FOR DETERMINING THE SIZE AND SHAPE OF A FOOT

FIELD OF THE INVENTION

The present invention relates to a method and apparatus for obtaining the size and shape of a foot from a scan of an imprint of the foot for use in manufacturing orthotic shoes and sandals and orthotic inserts to a shoe.

BACKGROUND OF THE INVENTION

In many instances, it is necessary to provide an orthotic/orthopedic shoe insert, or a shoe, sandal or other footwear which is customized to meet a particular wearer's needs. For example, in some instances it is necessary to provide an insert which compensates for differences in the lengths of the legs of a human.

It is desirable for the footwear, such as the shoe itself or an insert for the shoe, to accurately mate with the wearer's foot. The two feet of a wearer may be different from one another, however, and both feet of one person may vary substantially from the feet of another person. Therefore, the shape, including the width, length, depth and curvature of one or both of the feet of the person must be accurately determined for use in preparing the shoe or insert.

Current methods for determining the size and shape of the foot are imprecise and slow. For example, the size of the foot may be measured with a mechanical measuring device, and the shape estimated using templates. The error introduced in these methods often renders the orthotic or shoe unsatisfactory. In addition, this foot size and shape data is difficult to utilize when manufacturing the orthotic.

SUMMARY OF THE INVENTION

The present invention generally comprises a method and apparatus for determining the shape and dimensions of a human foot. One embodiment of the invention comprises a method of determining the shape and size of a foot comprising the steps of obtaining an imprint of the foot, scanning the imprint of the foot to obtain pixel image data regarding the foot imprint at one or more points, determining at said one or more points the depth of the imprint from the pixel image data, and determining a size of said foot from the pixel image data.

In one embodiment, the step of obtaining an imprint of the foot comprises the step of a person stepping onto a foam member and compressing a portion of the foam member. In one embodiment, an imprint may be created of both feet of a person.

In one embodiment, the step of scanning the imprint generates RGB (red, green, blue) pixel image data. The RGB data is converted to YIQ image data. The depth of the imprint at a point is determined from the luminance or Y value of the pixel data for a point.

In one embodiment, the depth is calculated as a linear function of the Y value and a slope of the Y value at that point. In this calculation, coefficients are used to accurately determine the depth value. In one embodiment, the coefficients are determined using a method of least squares to minimize the average error. In another embodiment, the coefficients may be determined by physically measuring the depth of the imprint and calculating the coefficient values from the known data.

In one or more embodiments, foot size information is determined from the image data. In one embodiment, an original scan image of the imprint is passed through a filter. The filtered image is utilized to generate an enhanced original image. The edge and sharp transition areas of the imprint, and thus the foot, are enhanced in this image. The visually enhanced edge areas aid in defining the start and/or end points for distance or "size" measurements.

In accordance with the invention, the curvature of one or more areas of the foot may be determined. In one embodiment, the curvature of the arch is determined.

In accordance with the invention, the size and shape of a foot may be determined from an image scan of an imprint of the foot. The size and shape data may be used to create an orthotic, shoe or other member which mates accurately with the foot. In one embodiment, the information may be transmitted, compressed and transmitted, stored or the like. For example, the foot size and shape data may be stored for comparison against later data so that changes in the size and shape of a person's foot may be determined.

Further objects, features, and advantages of the present invention over the prior art will become apparent from the detailed description of the drawings which follows, when considered with the attached figures.

DETAILED DESCRIPTION OF THE INVENTION

The invention is a method and apparatus for determining the size and shape of a foot. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
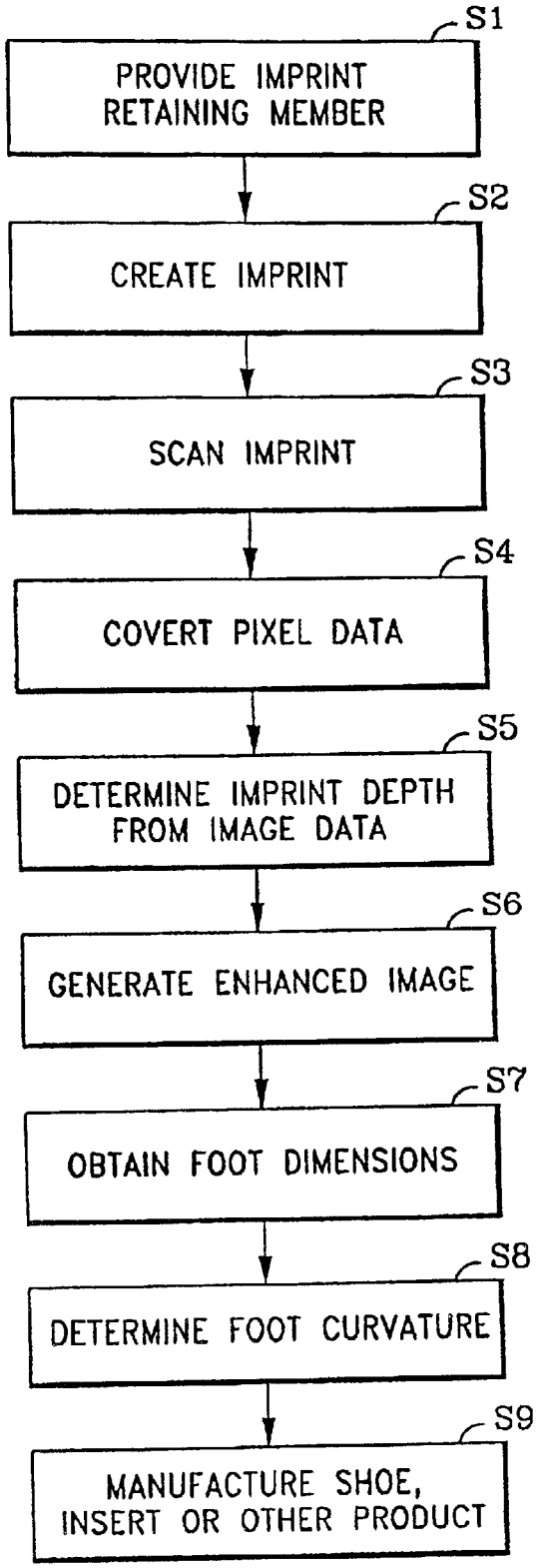
FIG. 1 is a flow diagram illustrating a method of scanning a foot in accordance with the present invention.
Figure 2:
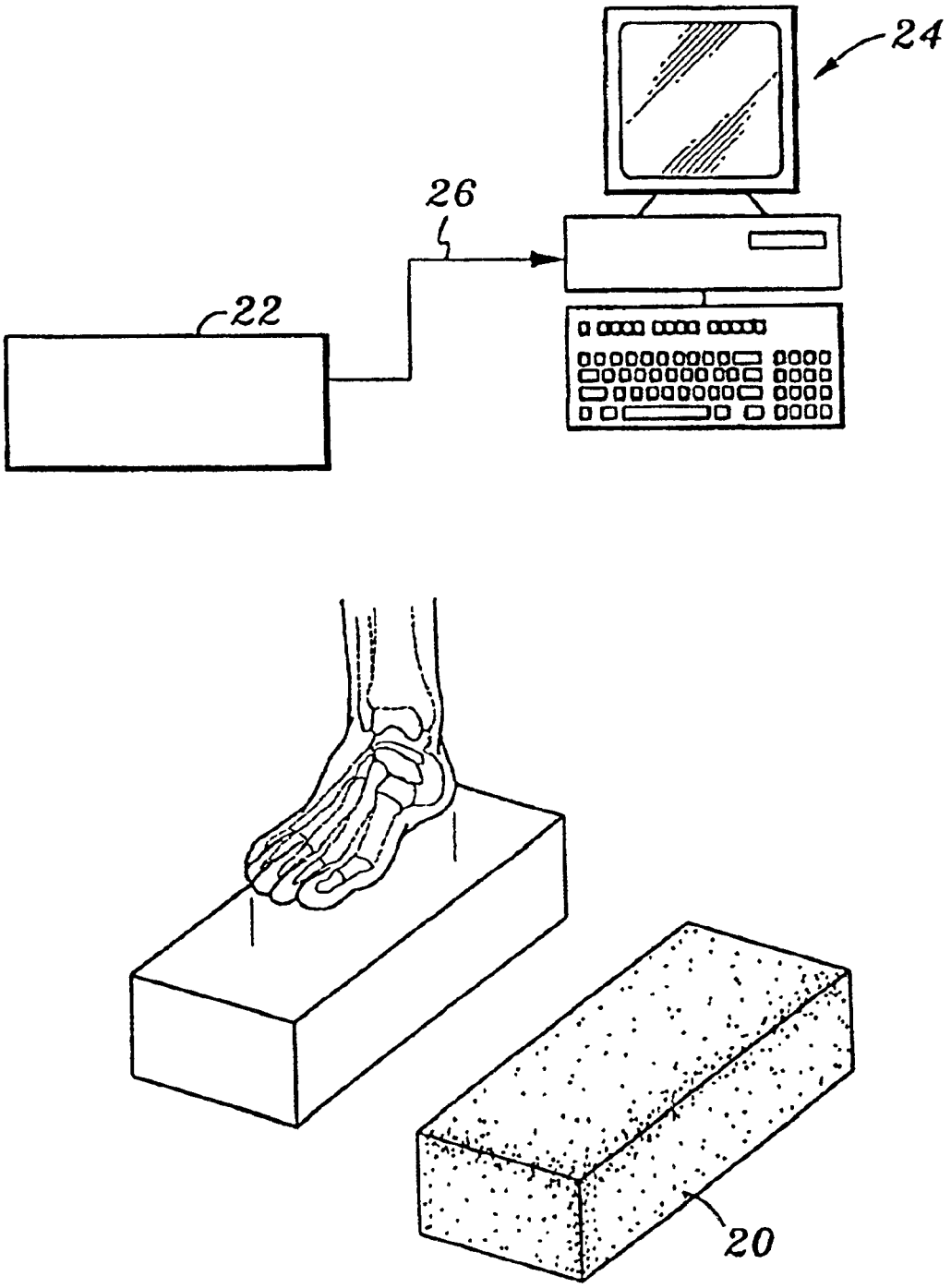
FIG. 2 illustrates hardware for use in a method of the present invention.

One embodiment of the invention comprises a method for determining the size and shape of a human foot based on an imprint of the foot. A method of the present invention will be described with reference first to FIG. 1. In a step S1, an element for retaining a physical representation of a foot is provided. In one or more embodiments, the element for retaining the physical representation comprises a foam member. Such a foam member 20 is illustrated in FIG. 2.

In an embodiment where an imprint of a foot is to be created, the foam member 20 is selected to be larger than the size of the foot which is to create the imprint. It will be appreciated that in one embodiment, a foam member 20 is provided for each foot for which an imprint is desired, i.e., in the case of both feet, one for the right foot and the other for the left foot. The foam member 20 is preferably of a greater width and length than the foot which is to provide the imprint. In addition, the foam member 20 is preferably of sufficient depth to retain an imprint which is as deep as the foot being imprinted.

Each foam member 20 is arranged to retain, with exacting geometric accuracy, the imprint of the foot of the person. Thus, when the person steps down on a top surface of the foam member 20, the foam member is arranged to compress in those areas where the user's foot makes contact. The remaining portions of the foam member 20 are preferably not deformed during the imprinting, and once the imprint is made, the foam member preferably retains the imprint. In other words, the foam member 20 must be sufficiently compressible to permit creation of the imprint, and not be resilient in a manner which would result in destruction of the imprint after its formation. Such foam members 20 are known and currently available, such as from the company Foot Levelers, Inc. It is contemplated that the foot imprint may be created and retained with other materials, such as with plasters and the like.

In the preferred embodiment of the invention, the method and apparatus is directed to determining the dimensions and shape of a foot. It will be appreciated that the method and apparatus may be utilized to provide shape and size information of other parts of the body, such as a hand, or even inanimate objects.

In a step S2 of the method, the person steps on the foam member to generate an imprint of the foot in the foam member. Of course, in an embodiment where the shape of something other than a foot is to be physically retained, then that element is pressed into the foam member. For example, the shape of a hand may be retained by pressing the hand into a foam member.

Figure 3:
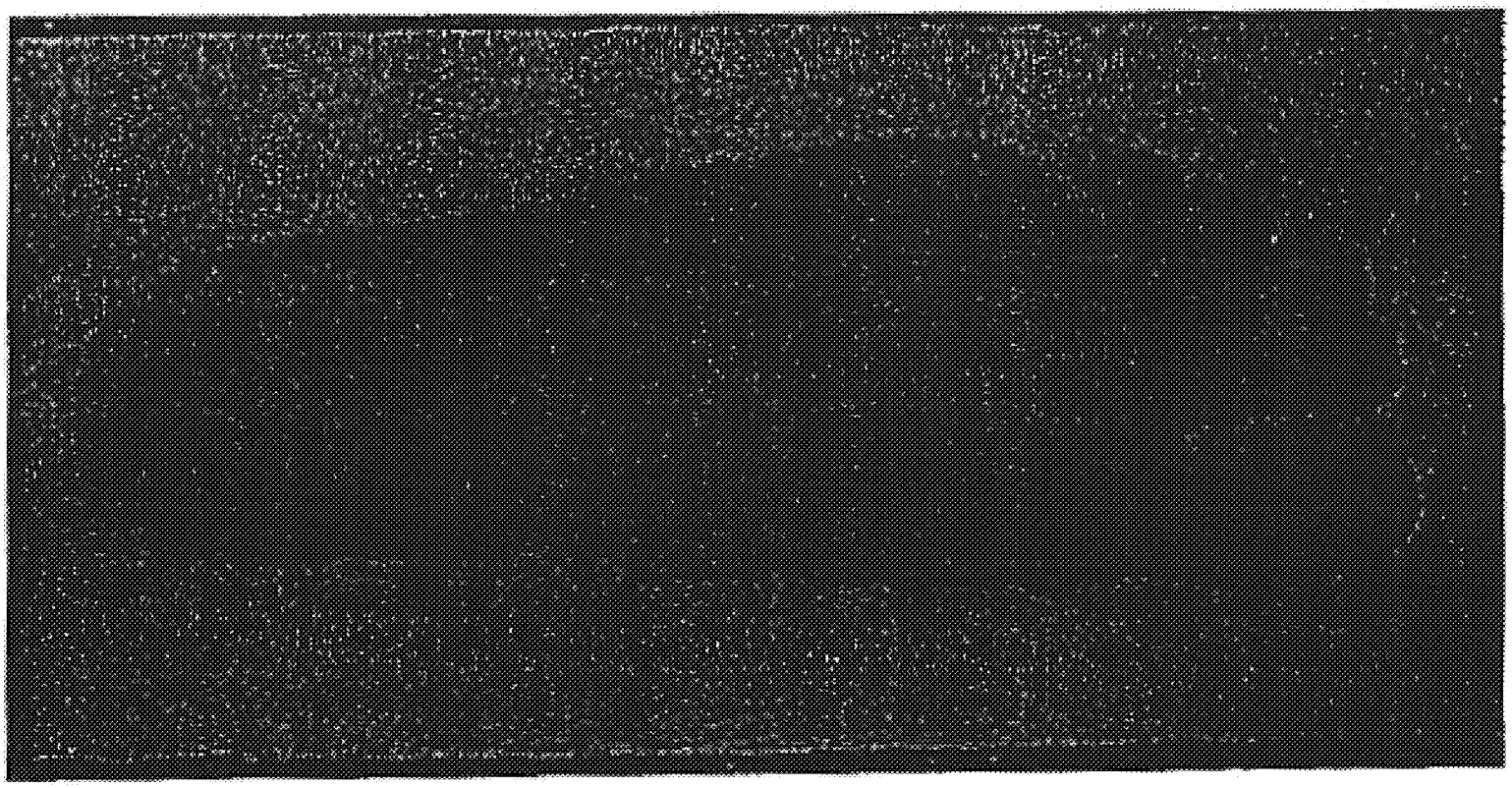
FIG. 3 illustrates a scanned image of a foam imprint of left foot.
Figure 4:
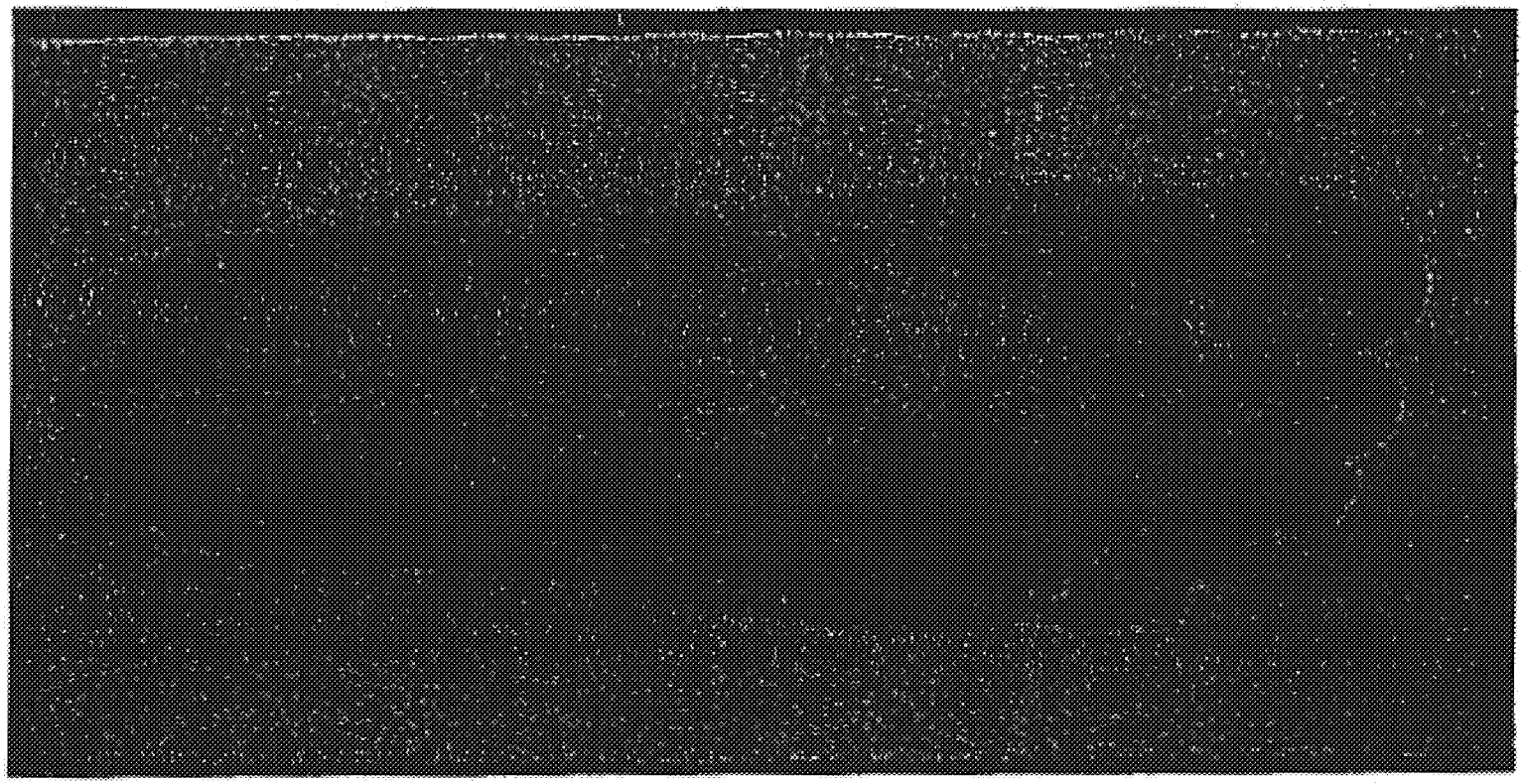
FIG. 4 illustrates a scanned image of a foam imprint of a right foot.

In a step S3, each of the foam imprints is scanned via a scanner connected to a computer to generate an imprint image. In one embodiment the scanner comprises an optical scanner. In one or more embodiments, the scanner is modified so that the foam imprints are retained in a fixed position and the scanner is arranged to move relative thereto. In another embodiment, the scanner may be fixed and the foot imprint moved relative thereto. The scanner is arranged to scan the imprint of the foot in the foam member and provide red-blue-green (RGB) image scan data. In general, this step comprises the scanner representing areas of the foam imprint with a plurality of individual pixels, each pixel represented by RGB data. In one embodiment, an origin is selected for the pixels and the pixels are arranged into k-columns and m-rows. In one embodiment, the origin for the pixels is chosen to be located at the top-left corner of the foam element 20. Each pixel then has an associated coordinate (k,m), with the origin pixel having coordinates (0,0). FIGS. 3 and 4 illustrate scans of foam imprints of a right foot and left foot of a person.

In a preferred embodiment, the RGB data representing the scanned images of the foam imprints of the feet are transmitted to a computer or other processing device. In one embodiment, the scanned image information is transferred to a computer to which the scanner is connected via an interconnecting communication cable.

FIG. 2 illustrates hardware which may be utilized to accomplished the scanning process. As illustrated, the hardware may include an optical scanner 22. In a preferred embodiment, a communication link is provided between the scanner 22 and a computer 24. As illustrated, this link comprises a cable 26. Of course, the link may be wired or wireless and follow any of a variety of protocols/architectures, such as serial/parallel.

In a step S4, the RGB data is converted to YIQ data, where Y represents the luminance and I and Q are the chrominance components corresponding to each pixel. A variety of methods and apparatus are well known to those of skill in the art for accomplishing this conversion. As such, this step will not be described in detail herein.

In a step S5, the depth of the imprint is determined using the pixel image data. In one embodiment, the portion of the top surface of the foam member which is undisturbed is considered to have a zero depth, and the depth of the footprint is measured relative to the undisturbed surface.

For an arbitrary pixel with coordinates (k, m), the depth $d_{km}$ of the imprint may be represented as a linear function of the luminance $Y_{km}$, and the absolute slope of the luminance $S_{km}$.

Thus:

$$d_{km}=aY_{km}+bS_{km}+c+\epsilon_{km}$$

This function may be re-represented as:

$$\epsilon_{km}=d_{km}-aY_{km}-bS_{km}-c$$

or $$\sum_{k=1}^{h}\sum^{v}\varepsilon_{km}^2=\sum_{k=1}^{h}\sum_{m=1}^{v}(d_{km}-aY_{km}-bS_{km}-c)^2$$

In one embodiment, a method of least squares is employed to estimate the parameters a, b, c. Therefore, in the function:

$$f(a,b,c)=\sum_{k=1}^{h}\sum_{m=1}^{v}(d_{km}-aY_{km}-bS_{km}-c)^2$$

it is necessary to estimate the coefficients (a, b, c) which minimize the function. In one embodiment, this step comprises computing the partial derivatives with respect to a, b, c, setting them to zero and solving the system with respect to a, b, c.

$$\frac{\partial f(a,b,c)}{\partial a}=-2\sum_{k=1}^{h}\sum_{m=1}^{v}(d_{km}-aY_{km}^2-bS_{km}Y_{km}-cY_{km})=0$$

$$\frac{\partial f(a,b,c)}{\partial b}=-2\sum_{k=1}^{h}\sum_{m=1}^{v}(d_{km}S_{km}-aY_{km}S_{km}-bS_{km}^2-cS_{km})=0$$

$$\frac{\partial f(a,b,c)}{\partial c}=-2\sum_{k=1}^{h}\sum_{m=1}^{v}(d_{km}-aY_{km}-bS_{km}-c)$$

This last function can be written as $$\bar{d}=a\bar{Y}+b\bar{S}+c$$

or $$c=\bar{d}-a\bar{Y}-b\bar{S}$$

From the above it will be seen that:

$$a=\frac{\sum_{k=1}^{h}\sum_{m=1}^{v}(d_{km}-\bar{d})(Y_{km}-\bar{Y})\sum_{k=1}^{h}\sum_{m=1}^{v}(S_{km}-\bar{S})^2-\sum_{k=1}^{h}\sum_{m=1}^{v}(S_{km}-\bar{S})(Y_{km}-\bar{Y})\sum_{k=1}^{h}\sum_{m=1}^{v}(S_{km}-\bar{S})(d_{km}-\bar{d})}{\sum_{k=1}^{h}\sum_{m=1}^{v}(Y_{km}-\bar{Y})^2\sum_{k=1}^{h}\sum_{m=1}^{v}(S_{km}-\bar{S})^2-\sum_{k=1}^{h}\sum_{m=1}^{v}((S_{km}-\bar{S})(Y_{km}-\bar{Y}))^2}$$

$$b=\frac{\sum_{k=1}^{h}\sum_{m=1}^{v}(Y_{km}-\bar{Y})\sum_{k=1}^{h}\sum_{m=1}^{v}(S_{km}-\bar{S})(d_{km}-\bar{d})-\sum_{k=1}^{h}\sum_{m=1}^{v}(d_{km}-\bar{d})(Y_{km}-\bar{Y})\sum_{k=1}^{h}\sum_{m=1}^{v}(S_{km}-\bar{S})(Y_{km}-\bar{Y})}{\sum_{k=1}^{h}\sum_{m=1}^{v}(Y_{km}-\bar{Y})^2\sum_{k=1}^{h}\sum_{m=1}^{v}(S_{km}-\bar{S})^2-\sum_{k=1}^{h}\sum_{m=1}^{v}((S_{km}-\bar{S})(Y_{km}-\bar{Y}))^2}$$

Figure 5:
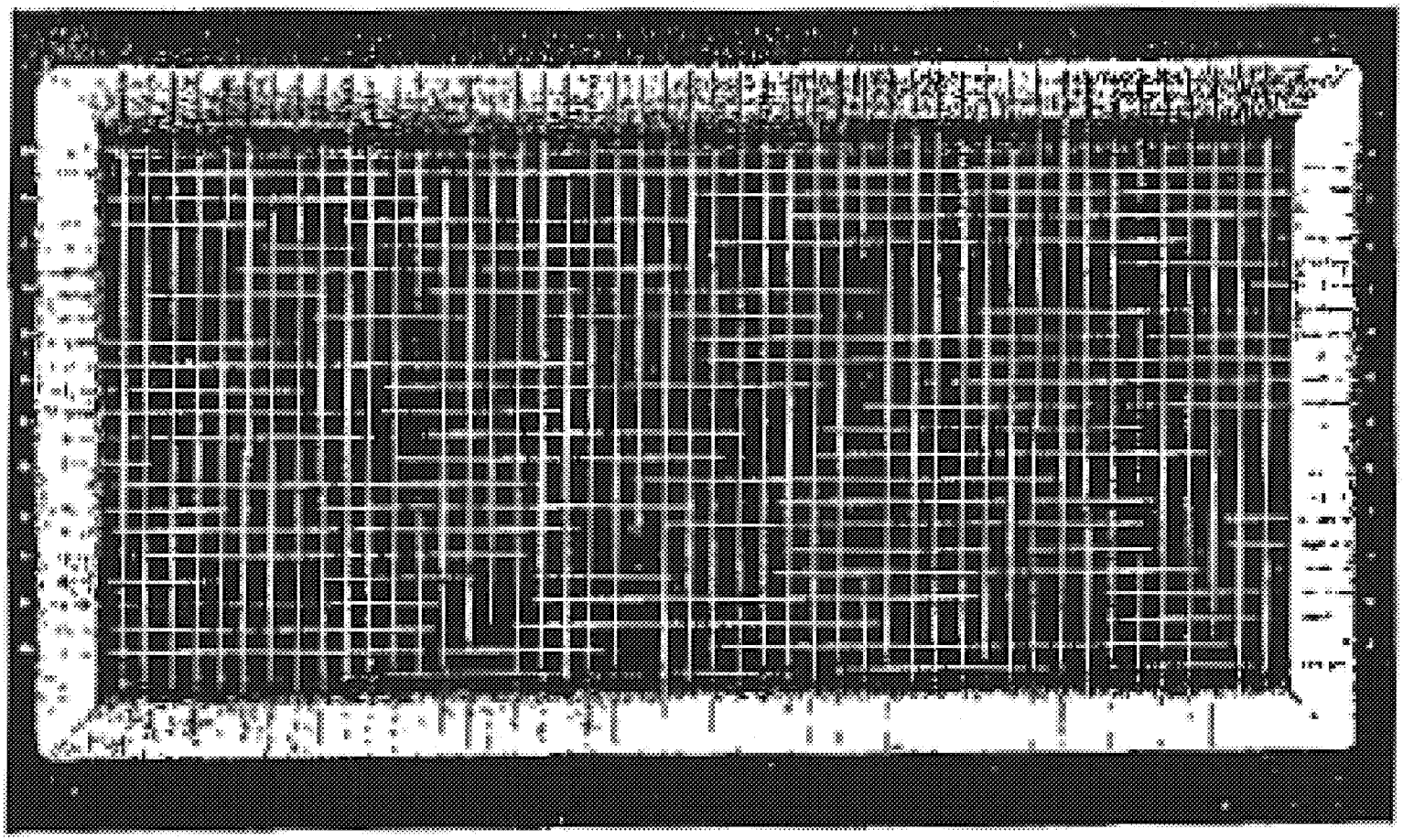
FIG. 5 illustrates a grid used for measuring a foam imprint of a foot.

In one or more embodiments, the values $d_{km}$ k=1, . . . ,h, and m=1, . . . ,v, comprising the horizontal and vertical coordinates respectively, the values of h, comprising the horizontal resolution in number of pixels, and the values of v, comprising the vertical resolution in number of pixels, are measured directly from the foam imprints of feet. In one embodiment, a grid 30 is used in this process. Referring to FIG. 5 there is illustrated such a grid 30. In one embodiment, the grid 30 comprises a generally rectangular frame having a plurality of elements defining horizontal and vertical positions. These elements may comprise wires or filaments extending between opposing portions of the frame. These elements define a grid of points and the intersections of these elements, each intersection point having (x, y) coordinates. In one embodiment, the elements are placed approximately 0.25 inches apart, such that each intersection point along a row or column is about 5 inches apart.

Figure 6:
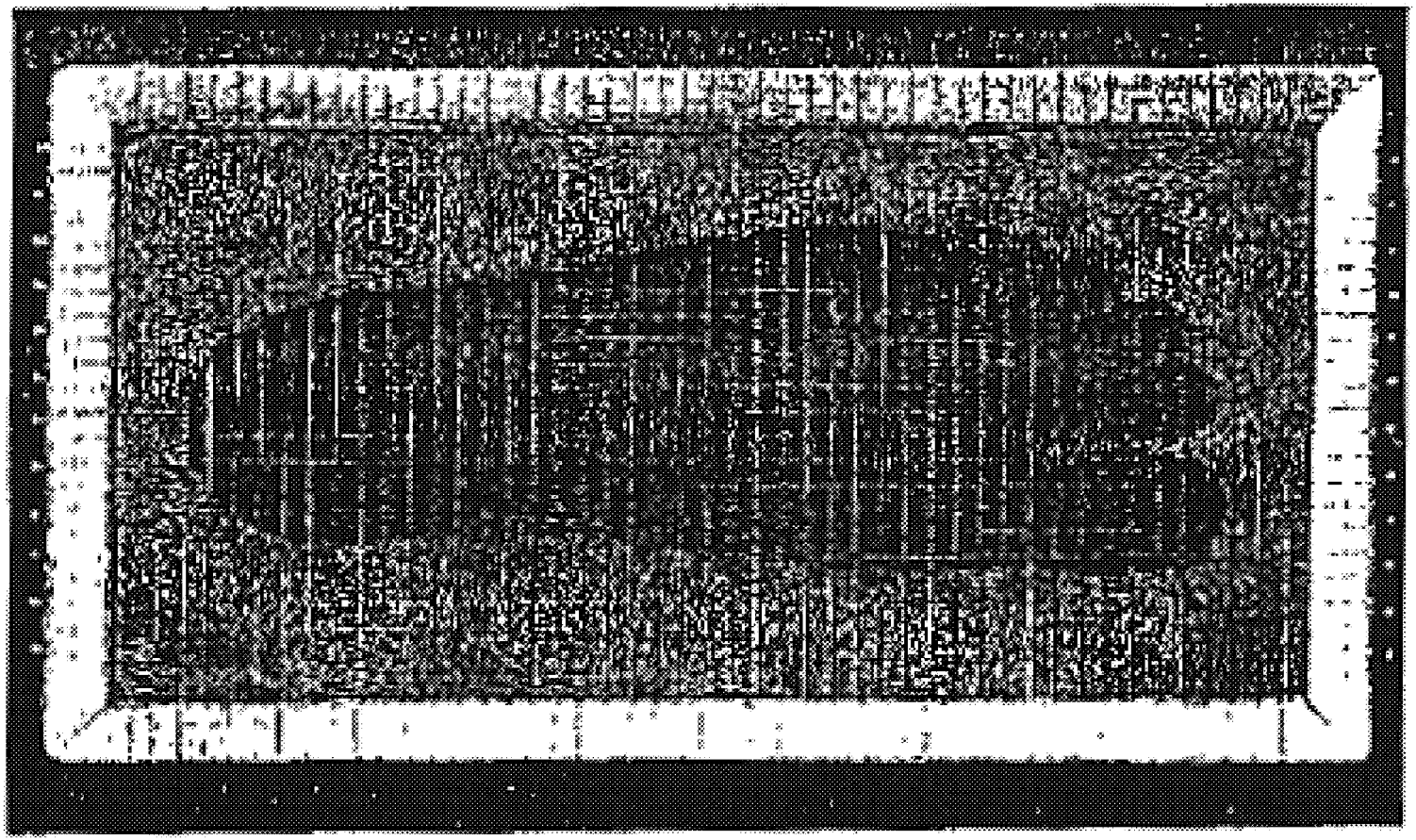
FIG. 6 illustrates the grid illustrated in FIG. 5 used to sample the depth of a foam imprint.
Figure 7:
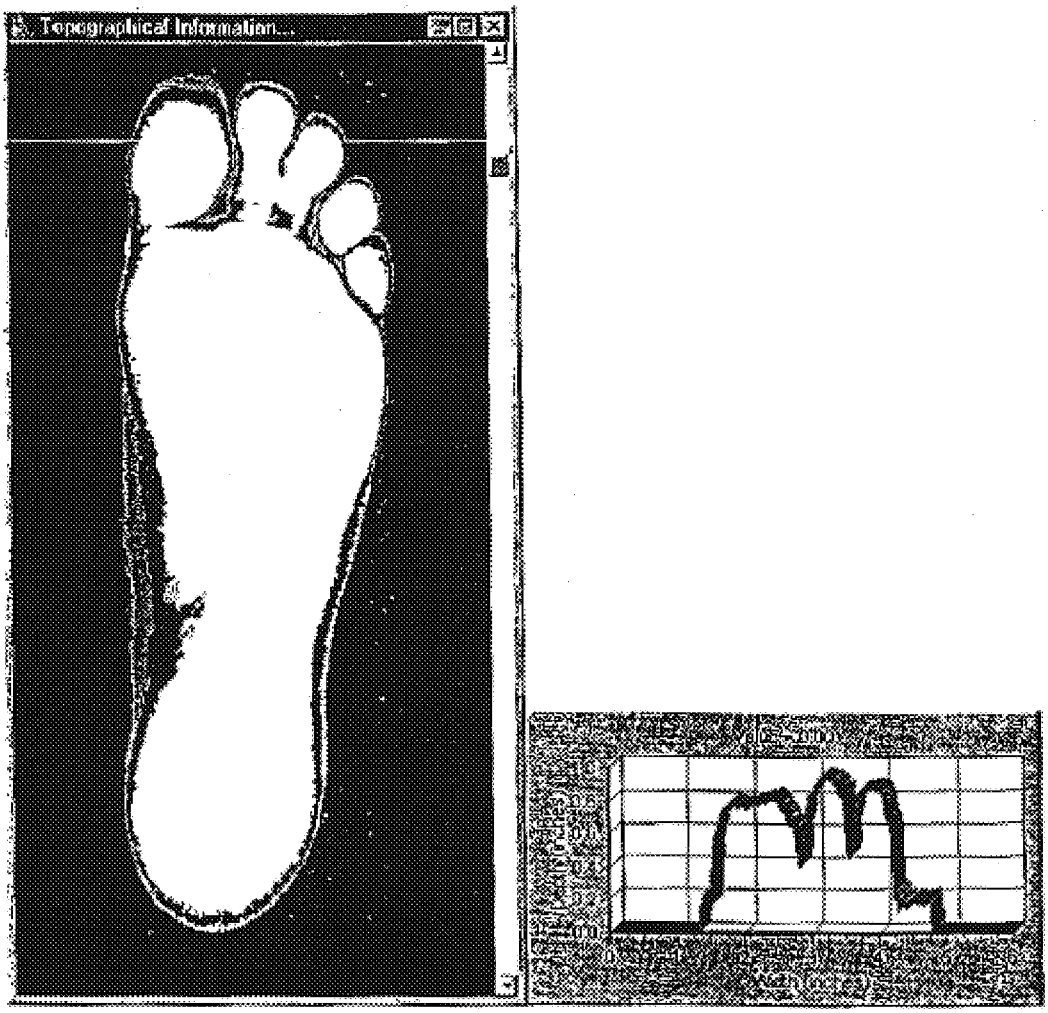
FIG. 7 is a topographical display and graph of toes of a foot generated utilizing information obtained in accordance with a method of the invention.
Figure 8:
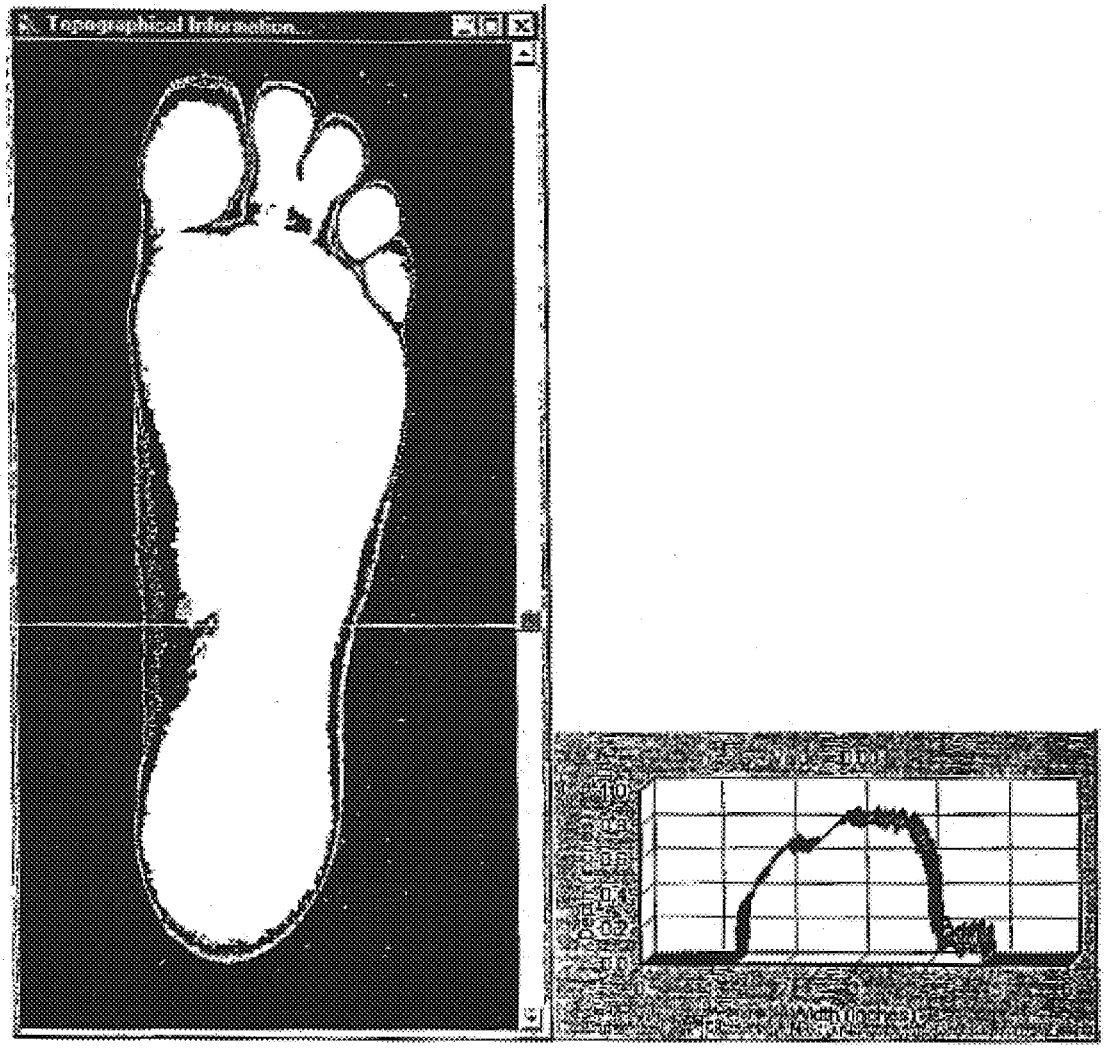
FIG. 8 is a topographical display and graph of an arch of a foot generated utilizing information obtained in accordance with a method of the invention.

As illustrated in FIG. 6, the grid 30 may be superimposed on the foam imprint of the foot. Next, the depth of the imprint at each of the intersection points may be determined. Furthermore, the luminance Y may be measured at each intersection point, and then the slope of the luminance S determined therefrom. Using the above formulas, this physically obtained data may be used to determine the values of the coefficients (a, b, c). Variations in the density and color of the foam pads and other noise/error introducing factors may change the values of the coefficients (a, b, c). It has been found, however, that the values (a, b, c) remain relatively constant across differing imprints made with like foam pads. In order to reduce any variance and increase the stability of the estimates, in one embodiment, a plurality of random foam imprints may be used to estimate the values of (a, b, c), with the values for each imprint averaged out and the average values used in the formula $d_{km}=aY_{km}+bS_{km}+c$.

In a step S6, an enhanced original image is generated for use in determining the size of the foot. In this step, it is desirable to generate an enhanced image of the foot imprint which permits easy measurement of the distances between edge or sharp transition areas of the various portion of the foot, such as the outer edge of the foot at the heel and the toes, and the intersection area of the toes with the foot.

Figure 9:
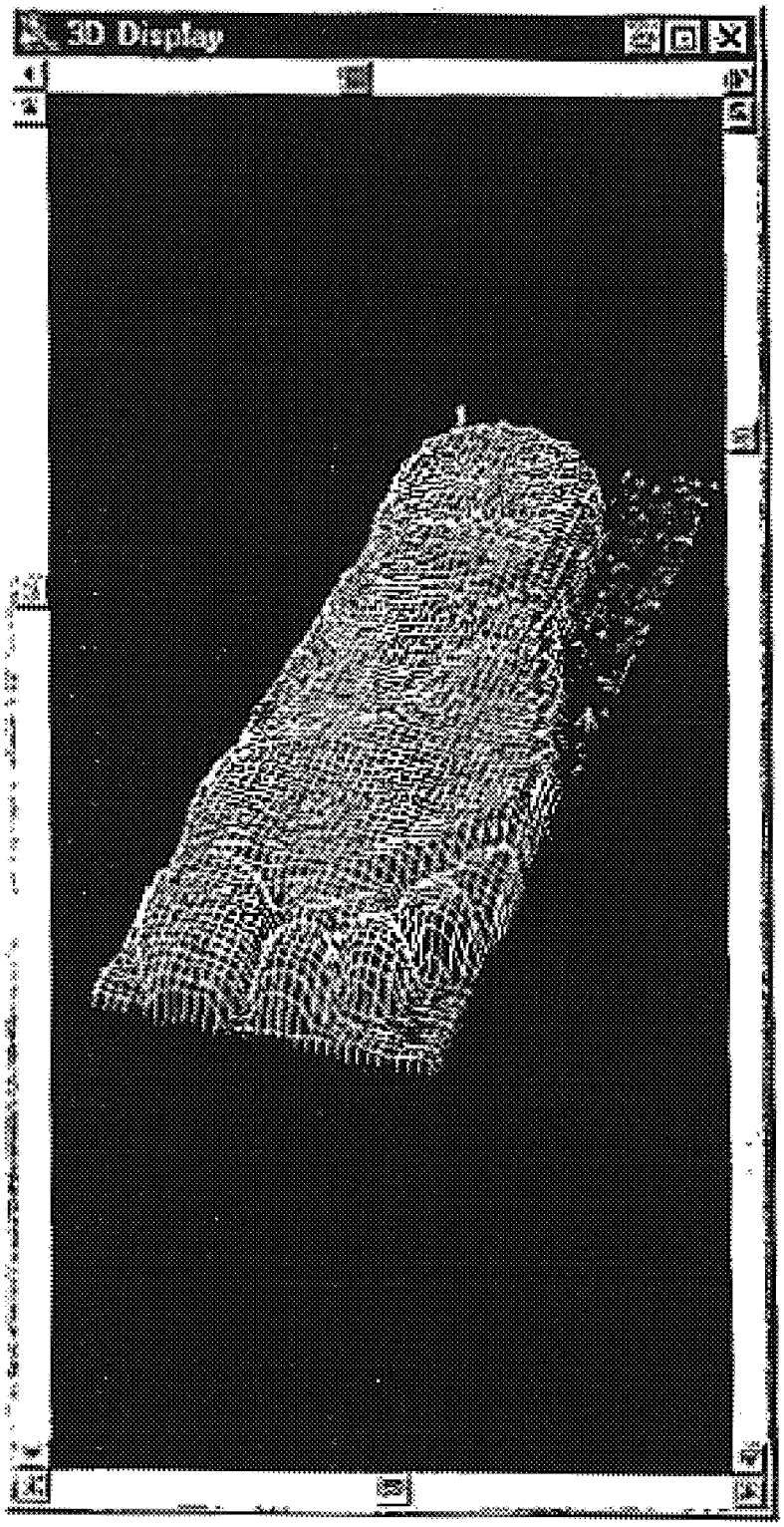
FIG. 9 is an open GL 3D-Display of an image of a foot generated utilizing information obtained in accordance with a method of the invention.
Figure 10:
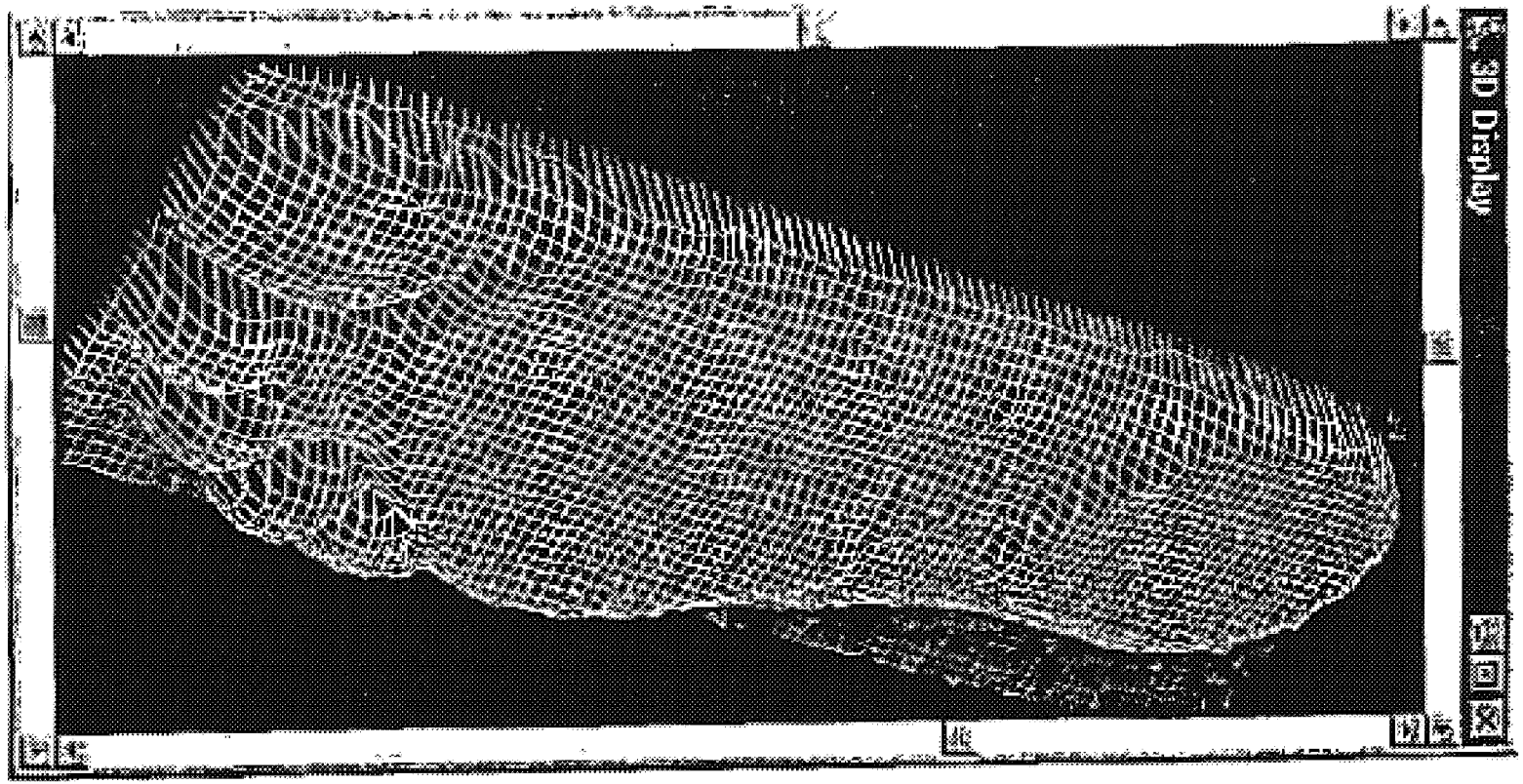
FIG. 10 is a 3-D image of a foot generated utilizing information obtained in accordance with a method of the invention, the image rotated and zoomed from that illustrated in FIG. 9.

In one embodiment, a filter is utilized to emphasize the data representing the scanned from imprint. In one embodiment, the pixel image data is passed through a low pass filter. This results in a filtered image which generally emphasizes the interior portions (i.e. non-edge areas) of the foot imprint. Next, the data (i.e. values) representing the filtered image are subtracted from the original image. In this step, a new altered image is generated which emphasizes the edge areas of the foot imprint; Lastly, an enhanced original image is created by adding the altered image data to the original image data. This generates an original image having the edge areas thereof visually enhanced. Such an image is illustrated in FIGS. 9 and 10.

In a step S7, data is obtained regarding other dimensions of the foot, such as the length and width of the foot. In one embodiment, this information is obtained from the enhanced original image of the foot. A variety of data may be obtained. In one embodiment, a distance from each toe end to the end of the heel of the foot is determined. In one or more embodiments, the distance from the phalanges from the left base corner of the large toe and the right base of the small toe is also obtained.

In a step S8, the curvature of the arch of the foot is determined. In one embodiment, the curvature is determined from the depth data, which permits calculation of the rate of change in the depth of the foot imprint (and thus the foot). In one embodiment, the depth information at points corresponding to the arch area of the foot imprint are utilized to obtain the curvature of the arch at various points there along.

In a step S9, an orthotic insert, shoe, sandal or a variety of other items may be created for exact mating with the foot of the person. For example, the foot shape and size data can be used to generate a mold for an orthotic insert or can be provided to a computer-controlled manufacturing device, for machining such an insert. This data can be transmitted over a communication network from a location where the imprint was obtained to a remote manufacturer. For example, the imprint may be obtained at a doctor's office, and then the information transmitted to a manufacturer in another city for use in producing an insert. In one embodiment, the foot shape and size data may be compressed using a lossless compression algorithm to improve the speed and reliability of the data transfer.

In one or more embodiments, the image of the imprint and size and shape data may be displayed or printed. It will also be appreciated that a variety of the steps above may be accomplished with hardware or software. For example, the RGB to YIQ conversion may be accomplished with appropriate software.

In one or more embodiments, the foot data may be stored in a record. This record may include information regarding the person whose foot created the imprint. In one embodiment, foot imprint data may be obtained at differing times and then be compared to provide information regarding how the shape and size of the person's foot is changing over time.

The invention has a number of advantages. First, the invention comprises a user-friendly system which permits accurate determination of the size and shape of a foot. The invention includes a system and method for displaying the measurements on a screen and also creating and storing a the record pertaining to the person from whom the images of the feet were obtained. Hardware and software may be provided for automatically measuring the shape and size, including curvature, of the feet and may be used to estimate any changes in foot measurements since a previous measurement, thereby providing correction data needed to manufacture the orthotic shoes, or sole inserts.

In accordance with the invention, unique characteristics of a person's foot may be identified. For example, the method can be used to identify corns and callouses on a person's feet. Using the foot data which includes data of such features, the shoe, orthotic or the like can be customized to compensate for such features.

The method and apparatus provides a means for accurately determining the shape and size of a foot. This makes it possible to detect small changes in the shape or size of a foot, such as may be necessary to identify whether a particular corrective orthotic is having a beneficial effect upon the foot over time.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method of determining the shape and size of a foot comprising the steps of:

obtaining an imprint of the foot by compressing said foot into a compressible member;

scanning the imprint of the foot formed in said compressible member to obtain red, blue and green pixel image data regarding the foot imprint at one or more points;

determining at said one or more points the depth of the imprint from the image data;

determining the size of said foot imprint; and determining the curvature of one or more portions of said foot imprint.

2. The method in accordance with claim 1 including the step of converting said red, blue and green pixel image data to YIQ pixel data.

3. The method in accordance with claim 2 wherein said step of determining the depth comprises determining the depth of the imprint at a point from the Y pixel data for that point.

4. The method in accordance with claim 1 including the step of generating an altered image of said foot imprint and determining the size of said foot imprint from said altered image.

5. The method in accordance with claim 4 including the step of passing image data through a filter to create said altered image.

6. The method in accordance with claim 1 including the step of generating an element for mating with at least a portion of the foot using said depth, size and curvature information.

7. The method in accordance with claim 1 including the step of storing said depth, size and curvature information.

8. A method of determining the size and shape of a foot comprising:

obtaining scanned image data of an imprint of the foot at one or more points, said image data including a luminance value;

determining a depth of the imprint at one or more points in accordance with a linear function of the luminance value and a luminance value slope at one or more points.

9. The method in accordance with claim 8 wherein said luminance value and luminance value slope are modified by a first and a second coefficient, respectively.

10. The method in accordance with claim 9 wherein a value of said first and second coefficients is determined using a least square method to minimize the average error.

11. The method in accordance with claim 9 wherein a value of said first and second coefficients is determined by measurement.

12. A method of determining the size and shape of a foot comprising:

scanning an imprint of a foot to obtain pixel image data regarding the imprint at a plurality of points, said pixel image data including RGB color data;

determining the depth of said imprint at one or more points comprising the following steps:

converting said RGB data at one or more points to YIQ data; and determining the depth of said imprint at one or more points from the Y component of said data at said one or more points and the slope of the Y component at said one or more points;

determining the size of said foot from said imprint by:

enhancing said image by passing said pixel image data through a low pass filter; and measuring the size of said imprint generated from said filtered data; and determining the curvature of said foot from said imprint by calculating the rate of change of said depth information at said one or more points.

13. The method in accordance with claim 12 including the step of forming an imprint of said foot in a compressible member.

14. The method in accordance with claim 13 wherein said compressible member comprises a foam member.

* * * * *

UNITED STATES PATENT AND TRADEMARK OFFICE

CERTIFICATE OF CORRECTION

PATENT NO. : 6,735,547 B1 
DATED : May 11, 2004
INVENTOR(S) : Evangelos A. Yfantis It is certified that error appears in the above-identified patent and that said Letters Patent is hereby corrected as shown below:

Column 5,
Lines 20-33, please delete the following:

$$"b=\frac{\sum_{k=1}^{h}\sum_{m=1}^{v}(Y_{km}-\bar{Y})\sum_{k=1}^{h}\sum_{m=1}^{v}(S_{km}-\bar{S})(d_{km}-\bar{d})-\sum_{k=1}^{k}\sum_{m=1}^{v}(d_{km}-\bar{d})(Y_{km}-\bar{Y})\sum_{k=1}^{h}\sum_{m=1}^{v}(S_{km}-\bar{S})(Y_{km}-\bar{Y})}{\sum_{k=1}^{h}\sum_{m=1}^{v}(Y_{km}-\bar{Y})^2\sum_{k=1}^{h}\sum_{m=1}^{v}(S_{km}-\bar{S})^2-\sum_{k=1}^{h}\sum_{m=1}^{v}((S_{km}-\bar{S})(Y_{km}-\bar{Y}))^2"}$$

and insert in its place $$--b=\frac{\sum_{k=1}^{h}\sum_{m=1}^{v}(Y_{km}-\bar{Y})^2\sum_{k=1}^{h}\sum_{m=1}^{v}(S_{km}-\bar{S})(d_{km}-\bar{d})-\sum_{k=1}^{k}\sum_{m=1}^{v}(d_{km}-\bar{d})(Y_{km}-\bar{Y})\sum_{k=1}^{h}\sum_{m=1}^{v}(S_{km}-\bar{S})(Y_{km}-\bar{Y})}{\sum_{k=1}^{h}\sum_{m=1}^{v}(Y_{km}-\bar{Y})^2\sum_{k=1}^{h}\sum_{m=1}^{v}(S_{km}-\bar{S})^2-\sum_{k=1}^{h}\sum_{m=1}^{v}((S_{km}-\bar{S})(Y_{km}-\bar{Y}))^2--}$$

Line 50, please delete "5 inches" and insert in its place -- .25 inches --

Column 6,
Line 9, please delete "from" and insert in its place -- foot --

Signed and Sealed this

Thirtieth Day of November, 2004

JON W. DUDAS
*Director of the United States Patent and Trademark Office*